US007334707B2

(12) United States Patent
Hoskins

(10) Patent No.: US 7,334,707 B2
(45) Date of Patent: Feb. 26, 2008

(54) HYDRATION PACK AND BITE VALVE THEREOF

(75) Inventor: Matthew Hoskins, Bend, OR (US)

(73) Assignee: Hines Enterprise L.L.C., Holliston, MA (US)

( * ) Notice: Subject to any disclaimer, the term of this patent is extended or adjusted under 35 U.S.C. 154(b) by 41 days.

(21) Appl. No.: 10/947,045

(22) Filed: Sep. 22, 2004

(65) Prior Publication Data

US 2005/0062009 A1 Mar. 24, 2005

Related U.S. Application Data

(60) Provisional application No. 60/504,440, filed on Sep. 22, 2003.

(51) Int. Cl.
*F16L 35/00* (2006.01)

(52) U.S. Cl. ..... 222/175; 222/527; 222/529; 251/342; 224/148.2

(58) Field of Classification Search ..... 251/341–344; 220/714; 222/175, 499, 522, 527–529; 224/148.2; 239/533.13
See application file for complete search history.

(56) References Cited

U.S. PATENT DOCUMENTS

| | | | | |
|---|---|---|---|---|
| 6,279,627 | B1 * | 8/2001 | Kelly | 141/352 |
| 6,364,178 | B1 * | 4/2002 | Paczonay | 222/522 |
| 6,708,950 | B2 * | 3/2004 | Christensen et al. | 251/342 |
| 2003/0173536 | A1 * | 9/2003 | Christensen et al. | 251/342 |

* cited by examiner

*Primary Examiner*—J. Casimer Jacyna
(74) *Attorney, Agent, or Firm*—Rossi, Kimms & McDowell LLP

(57) ABSTRACT

A hydration pack has a reservoir for holding fluid, a fluid conduit extending from the reservoir for passage of the fluid from the reservoir, and a bite valve connected to a distal end of the fluid conduit. The bite valve includes a deformable sleeve having an open end defining an inlet and a closed end. At least one outlet is formed between the inlet and the closed end. A sheath is shrouded over all of the outlets and seals the same. The closed end of the sleeve extends beyond the sheath to provide a bite engagement area for opening the valve. Deforming the sleeve at the bite engagement area moves at least one of the outlets away from the sheath to allow fluid flow through the outlet.

19 Claims, 3 Drawing Sheets

HYDRATION PACK AND BITE VALVE THEREOF

This application claims priority to provisional application 60/504,440 filed Sep. 22, 2003.

BACKGROUND

Sufficient hydration is important for replacing bodily fluids during extended periods of aerobic activity, such as cycling, roller blading, running, etc. Currently, several methods are known for supplying fluids to a person. One way is for the person to stop the aerobic activity and take a drink, such as at aid stations or water fountain. This method, however, disrupts the aerobic activity and is not suited for events like competitive cycling races. It is desirable to make replenishment fluid available without the need for slowing or stopping the aerobic activity. Water bottles carried by persons engaged in aerobic activity represent an attempt to overcome the problems associated with aid stations. However, drinking via-a water bottle requires use of one or both hands. Therefore, water bottles are not convenient, and can present safety hazards, particularly to cyclists.

In an attempt to overcome the deficiencies of water bottles, hydration systems have been developed. Conventional hydration systems include a flexible reservoir for holding fluid, a flexible tube for conveying the fluid from the reservoir to a user, and a valve, such as a mouth operated bite valve, attached to the end of the tube. The user can replenish fluids by placing the outlet of the valve in his or her mouth and biting down on a flexible valve covering. The valve covering deforms to open a seal and allow fluid from the reservoir to flow into the person's mouth. Current valves often require orientation of the valve so that the biting action properly opens the fluid outlet, namely a slit. Other valves, such as disclosed in U.S. Pat. No. 6,039,603, feature valve configurations that do not require initial orientation, but contain rigid features that are uncomfortable to bite down upon. Some of the known bite valves do not provide adequate flow, requiring the user to not only bite down, but apply suction, which can be difficult especially when the user is undergoing a strenuous activity. In this respect, ON-OFF rotating type valves have been contemplated to provide better flow control. But the ON-OFF type valve requires the user to manipulate it with his or her hand and/or mouth, which is not all too convenient. The bite valves still remain popular because they are easy to operate.

Accordingly, there remains a need for a bite valve that can be activated from multiple orientations to deliver sufficient flow, while providing a soft compliant bite area. The present invention addresses this need.

SUMMARY OF THE INVENTION

The present invention relates to a hydration pack and a bite valve thereof.

One aspect of the present invention is a bite valve, which can include a sleeve and a sheath. The sleeve can have an inlet and at least one outlet for passage of fluid. The sheath covers and seals at least the outlet. The sleeve can have an activation portion for moving the outlet away from the outer sheath to permit passage of fluid through the outlet.

The sleeve can be made of a deformable material and can have an open end that defines the inlet. The sleeve can have a closed end, with the outlet being positioned between the inlet and the closed end and in fluid communication with the inlet.

The activation portion can extend beyond the sheath to provide a bite engagement section. The sleeve can have a sealing section and the bite engagement section that extends outwardly or longitudinally from the sealing section. The sheath can have a distal open end situated near the outlet so that deforming the bite engagement section moves the outlet away from the outer sheath for passage of fluid through the outlet and through the distal open end of the sheath. The bite engagement section thus extends outwardly from the distal open end of the sheath, and the outlet is in close proximity to the distal open end.

One of the sleeve and the sheath is configured to connect to a fluid supply conduit. That is, the fluid supply conduit can be connected to the sleeve or the sheath. For example, the inlet of the sleeve can be figured to connect to the fluid supply conduit. The sleeve can have four outlets for passage of fluid. A pair of biting platforms can be positioned diametrically opposite each other on the bite engagement section. The sheath can be substantially rigid while the sleeve is elastic.

The sleeve can have an outer dimension that is slightly larger than an inner dimension of the sheath so that an outer periphery of the sleeve expands and seals against an inner surface of the sheath.

Another aspect of the present invention is a hydration pack, which can include a reservoir for holding fluid, a fluid conduit extending from the reservoir for passage of the fluid from the reservoir, the above-described bite valve connected to a distal end of the fluid conduit.

DETAILED DESCRIPTION

Figure 1:
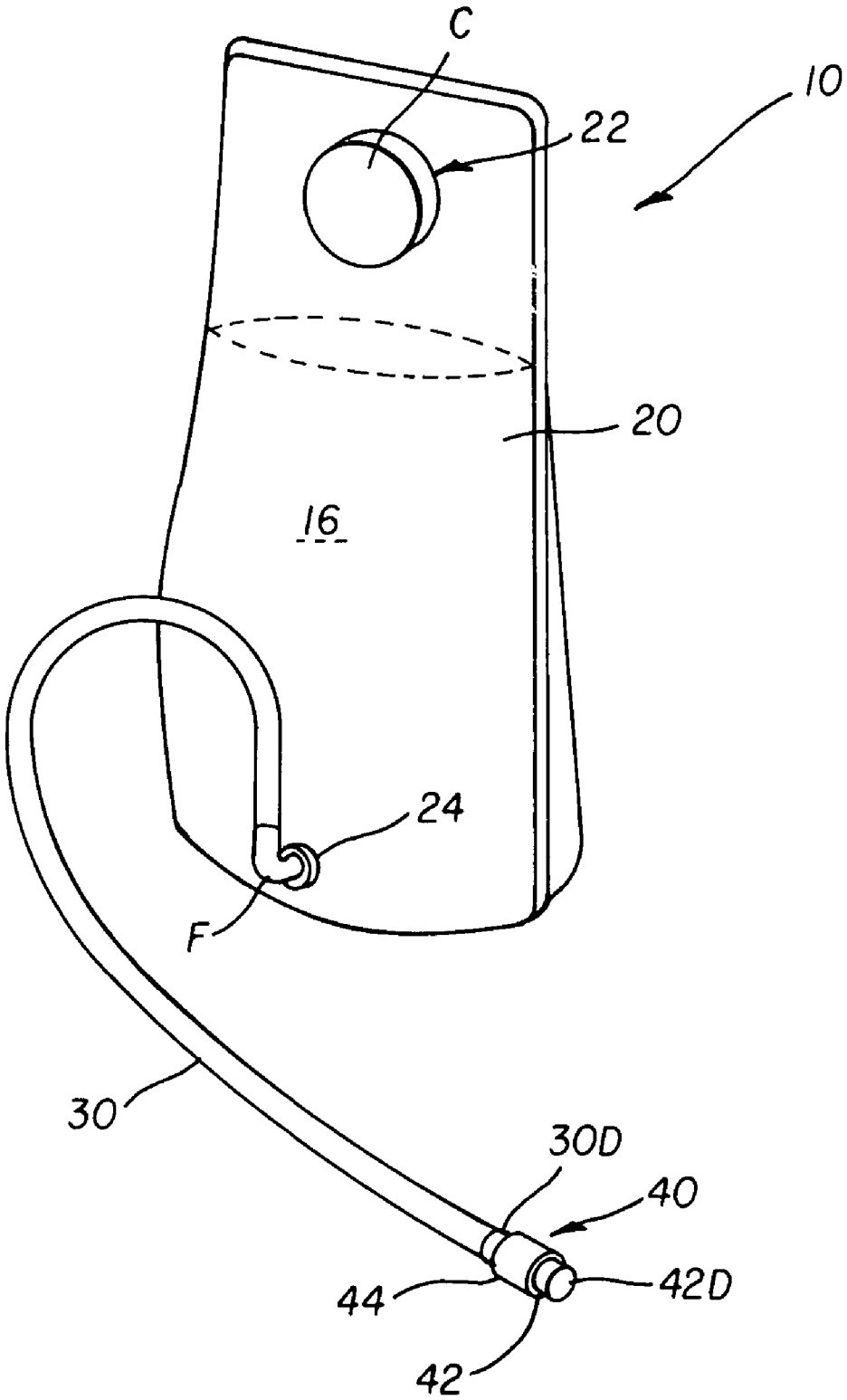
FIG. 1 illustrates a perspective view of a hydration pack according to the present invention.

FIG. 1 schematically illustrates a present hydration pack 10, which includes a reservoir 20 for holding fluid 16, such as water or sports drink, a conduit or tube 30 extending from the reservoir for supplying fluid to a remote location, and a bite valve 40 attached to the distal end of the tube 30 to control fluid flow. The pack 10 can further include a protective carrier (not illustrated), such as a bag that can hold the reservoir, with a harness for mounting, for example, to a person's back or cycle. The carrier can include insulation to keep fluid cold or hot.

The reservoir 20 can be made of any flexible material inert to the fluid, such as a thermoplastic or thermosetting polymer, polyethylene and polyvinyl chloride, and mylar. The reservoir 20 can be insulated. Alternatively, the carrier can be made of canvas with the insulation. The reservoir 20 can include a fill port 22 and a drain port 24. The fill port 22 can be positioned near one end (top) of the reservoir and sealed with a cap C, e.g., a screw-on cap that can be attached to the fill port in sealing engagement therewith. Alternatively, instead of the cap, the top of the reservoir can have a zip-top closure or roll-down closure structure that can be opened and closed across the full width of the reservoir for ease of filling and cleaning. The drain port 24 can be positioned at or near the other end (bottom), namely opposite the one end, of the reservoir. A drain fitting F can be sealingly attached to the drain port 24 and provide open fluid communication with the reservoir. While the drain fitting 26 has been illustrated as a 90° elbow shaped tube, it can be straight or angled as desired. The proximal end of the tube 30 is attached to the drain fitting F, for example by sliding over the end of the drain fitting. The tube 30 can be made from a flexible material, such as polyvinyl chloride or silicone rubber, or any flexible and material inert to the fluid being carried by the reservoir.

It should be noted that the reservoir of the type described above is well known. Various types and sizes of reservoirs and hydration packs are commercially available through, for instance, BLACKHAWK PRODUCTS GROUP, CAMELBAK PRODUCTS, INC., CASCADE DESIGNS, GREGORY MOUNTAIN PRODUCTS, MOUNTAIN EQUIPMENT CO-OP, REI, and ULTIMATE DIRECTION.

Figure 2:
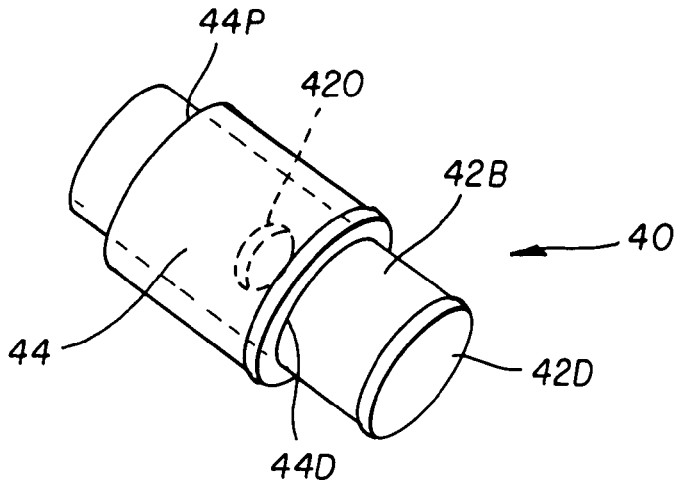
FIGS. 2 and 3 illustrate perspective views of the bite valve according to the present that can be incorporated in the present hydration pack.
Figure 3:
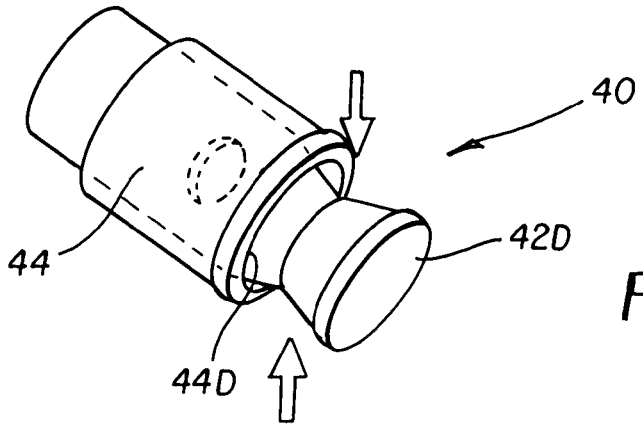
Figure 4:
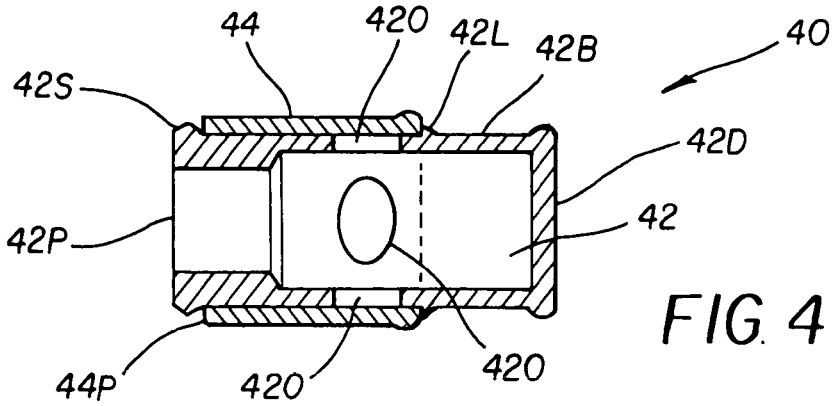
FIG. 4 illustrates a cross-sectional view of the bite valve of FIG. 2.

Referring to FIGS. 2-4, the bite valve 40 according to the present invention includes an inner member or sleeve 42 and an outer member or sheath 44 extending over a portion of the inner sleeve. The inner sleeve is preferably elastically deformable so that it can change in shape. The inner sleeve can be cylindrical or tubular, and can be defined as having a sealing section 42S and an activation portion, namely a bite engagement section 42B extending longitudinally from the sealing section. In practice, the inner sleeve can be a single monolithic piece made of a resilient, flexible elastomer, such as silicon rubber or polyvinyl chloride. The inner sleeve has a proximal open end or inlet 42P, which is on the proximal end of the sealing section 42S, and a distal closed end 42D, which is on the side of the bite engagement section 42B, opposite the inlet 42P. Between and spaced longitudinally away from both the distal end 42D and the proximal end 42P, one or more outlets 42O, namely openings, are formed around the wall of the inner sleeve 42 at the sealing section. Four outlets 42O are illustrated in the exemplary embodiment. See FIG. 2. However, only a single outlet is needed.

The outer sheath 44, which has a distal open end 44D and a proximal open end 44P, can be rigid or semi-rigid, namely any material that can retain its shape. The outer sheath 44 is shrouded over coaxially or concentrically, in sealing engagement with, the sealing section of the inner sleeve 42, with the outlets 42O positioned between the distal and proximal open ends of the outer sheath. The outer sheath 44 sealingly covers at least the outlets 42O. The bite engagement section 42B is defined between the distal closed end 42D of the inner sleeve 42 and the distal open end 44D of the outer sheath. Preferably, the distal open end 44D of the outer sheath 44 terminates close to or near the outlets 42O, namely at a distance at which there is sufficient contact between the outer sheath and the inner sleeve to form a seal and prevent fluid from leaking therethrough. The bite engagement section 42B thus extends longitudinally outwardly and coaxially from the outer sheath 44. To enable better seal and prevent leakage, the inner sleeve 42 can include a flange or lip 42L (see FIG. 4) extending circumferentially around the outer wall of the bite engagement section 42B and engaging the distal open end 44D of the outer sheath 44. The lip also acts as a stop to accurately position the distal open end 44D of the outer sheath 44 next to the openings 42O.

In the illustrated embodiment, the outer sheath and the inner sleeve are both cylindrical, but they can have any configuration, as long as they are complementarily configured. For instance, each of the inner sleeve and the outer sheath can have a triangular cross section.

The bite engagement section 42B is configured so that when it is deformed inwardly (see FIG. 3), such as with the user's teeth or hand, the inner sleeve is taken out of sealing engagement with the outer sheath 44 to allow the fluid to flow through the outlets 42O and out the outer sheath's distal open end 44D. Specifically, deforming the bite engagement section 42B causes the area surrounding the outlet 42O to separate from the inner surface of the outer sheath 44 to break the seal. In this respect, at least around the outlets 42O, the deformable inner sleeve 42 can have an outer diameter that is slightly greater than the inner diameter of outer sheath 44 to provide a surface that slightly expands and seals against the inner surface of the outer sheath. The outer perimeter or periphery of the sealing section of the inner sleeve thus defines a sealing area. The outlets 42O are positioned in close proximity to the outer sheath's distal open end 44D so that inward or biting deformation at the bite engagement section 42B reshapes and moves the inner sleeve at sealing section 42S, namely the openings, while the outer sheath maintains its shape. This creates a gap between the inner sleeve 42 and the outer sheath 44 to allow fluid flow through the outlets 42O and the distal open end 44D, as illustrated in FIG. 3.

The bite valve 40 can be assembled as follows. The inner sleeve 42 is inserted into the outer sheath 44 so that the outlets 42O are in close proximity to the distal open end 44D of the outer sheath 44. The distal end 30D of the tube 30 is slid into one of the inner sleeve 42 and the outer sheath 44. In the illustrated embodiment, the distal end 30D of the tube is slid into the proximal open end 42P of the inner sleeve 42 and is sealingly held in place by friction or known connecting means. For instance, the inner wall of the inner sleeve at the sealing section 42S can be dimensioned to provide an interference fit with the outer surface of the distal end 30D of the tube 40 to provide a seal. The reservoir 20 can be filled with fluid, such as water or a sports drink, through the fill port 22. Fluid flows from the reservoir 20 through the tube 30 and the proximal open end 42P of the inner sleeve 42 when the bite valve 40 is opened, such as biting the bite engagement section. However, upon releasing the bite engagement section, the inner sleeve reverts to its normal cylindrical shape to provide sealing engagement of the inner sleeve 42 with the interior of outer sheath 44 and prevent the fluid from exiting the outlets 42O.

During use, when hydration is desired, the user applies a force (schematically illustrated by the arrows) to the bite engagement section 42B of the inner sleeve 42, such as by gently biting the same between the user's incisors. The force can be suitably applied from any radial orientation about deformable member. As shown in FIG. 3, the force deforms the deformable sleeve 34 inward thereby distorting the sealing section 42 into an ovoid contour, pulling the inner sleeve 42 out of sealing engagement with the interior surface of the outer sheath 44. Fluid can thus flow through open end 44O.

Fluid flow may be driven by any of several mechanisms. For example, if the reservoir 20 is at a higher elevation than the bite valve 40, the pressure head of the fluid 16 in the reservoir 20 causes the fluid 16 to flow out the drain port 24, through the tube 30, through the bite valve 40 (when the valve is opened). If desired, a higher flow rate of the flow can be obtained by pressurizing fluid within the reservoir 20. For example, while the bite valve is open by deforming the bite engagement section, air can be blown through the bite valve and into the reservoir 20 to thereby pressurize the reservoir 20. With the reservoir 20 thus pressurized, the flow rate of the fluid 16 upon opening of the valve 40 can be increased, until pressure within the reservoir 20 equalizes with the ambient pressure. Pressurization of fluid within the reservoir can be alternately created by compressing the reservoir 20, such as by applying an expanded elastic sleeve (not shown) over the reservoir 20. It should be apparent that flow of the fluid 16 can be driven by either a gravity pressure head, pressurization of the fluid 16, or both.

It will be appreciated that the person engaged in aerobic activity can bite the deformable inner sleeve 42 anywhere around the periphery of the bite engagement area 42B. Thus, the deformable inner sleeve 42 can be taken out of sealing engagement with the interior sealing surface of the outer sheath 44 without the user having to worry about orienting the bite valve.

Figure 5:
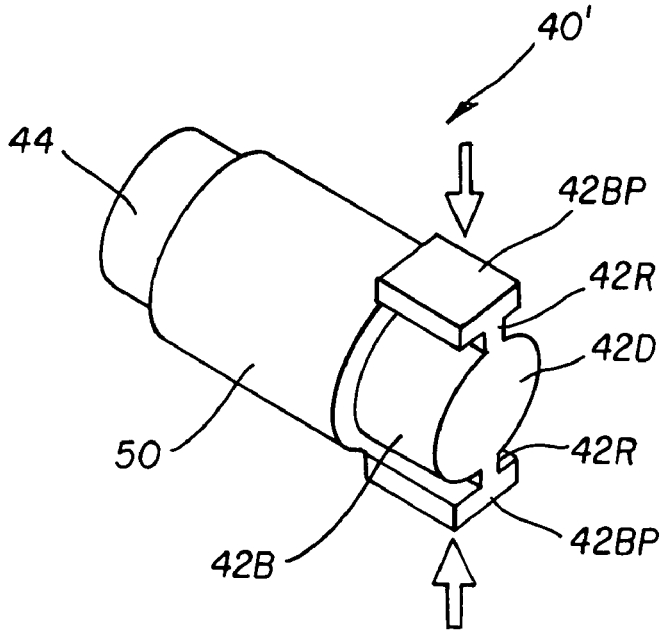
FIG. 5 illustrates a perspective view of an alternate embodiment of the bite valve according to the present invention.
Figure 6:
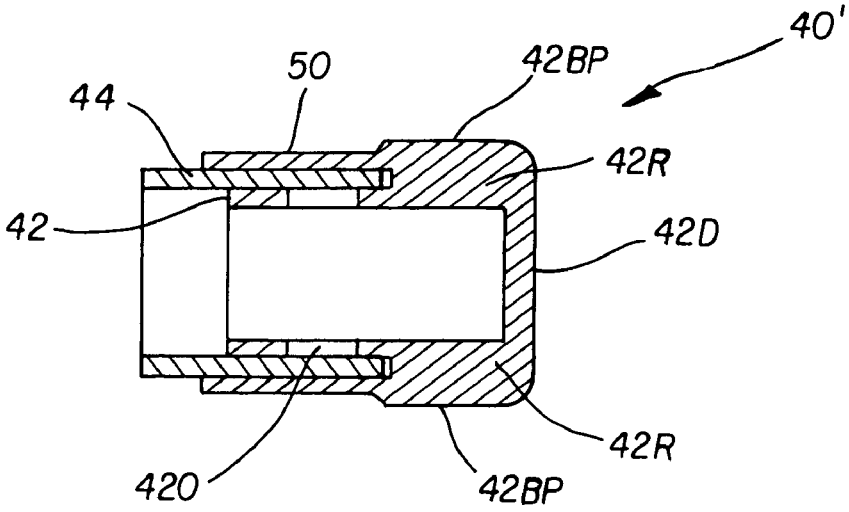
FIG. 6 illustrates a cross-sectional view of the bite valve of FIG. 5.

FIGS. 5 and 6 illustrate an alternate embodiment of a bite valve 40', which is substantially similar in construction as the bite valve 40 of FIGS. 2-4. Here, the bite valve 40' additionally includes a pair of bite platforms 42P positioned at the substantially diametrically opposing sides of the deformable sleeve 42. In FIGS. 5 and 6, they are illustrated as situated at the top (12 o'clock) and the bottom (6 o'clock) positions. The bite platforms 42BP each can be rectangularly shaped (or any shape that enlarges the bite contact area) and positioned substantially parallel relative to each other. Each platforms 42BP connects to the deformable sleeve 42 at the bite engagement area 42B via a thin rib 42R, which can extend the entire length of the bite engagement section 42B. The bite platforms can be attached to the outer sheath 44, for instance, using an elastomeric collar or sheath 50 that shrouds over the outer sheath 44. In the embodiment illustrated, the inner sleeve 42, the ribs 42R, the platforms 42BP, and the collar 50 are formed integrally or monolithically.

In the embodiment of FIGS. 5 and 6, the outer sheath 44 extends beyond the inlet or the proximal open end 42P of the inner sleeve 42. The distal end 30D of the tube can be attached to the outer sheath 44, such as by sliding the outer periphery into the inner periphery of the outer sheath 44.

In operation, the user applies biting force to the platforms 42BP. The inwardly deforming force is transferred through the ribs 42R, causing the deformable sleeve to come out of sealing contact with the inner wall of the outer sheath 44, allowing fluid to flow around the ribs 42R and between the bite platforms 42BP. In this embodiment, the raised bite platforms 42BP ensure that there is adequate space for fluid flow between the user's upper and lower teeth during valve actuation. That is, the bite platforms and the ribs functions as a spacer to space the upper and lower teeth to a predetermined amount to provide better flow.

Given the disclosure of the present invention, one versed in the art would appreciate that there may be other embodiments and modifications within the scope and spirit of the present invention. Accordingly, all modifications and equivalents attainable by one versed in the art from the present disclosure within the scope and spirit of the present invention are to be included as further embodiments of the present invention. The scope of the present invention accordingly is to be defined as set forth in the appended claims.

What is claimed is:

1. A bite valve comprising:

a sleeve having an inlet and at least one outlet for passage of fluid; and a sheath covering and sealing at least the outlet, wherein the sleeve has an activation portion for moving the outlet away from the sheath to permit passage of fluid through the outlet, wherein the sleeve is deformable and has an open end that defines the inlet, and has a closed end, the outlet being positioned between the inlet and the closed end and in fluid communication with the inlet, and wherein the sheath remains fixed in a longitudinal direction while continuously covering the sleeve before, during, and after activation of the sleeve.

2. The bite valve according to claim 1, wherein the activation portion extends beyond the sheath to provide a bite engagement section.

3. The bite valve according to claim 1, wherein the sleeve has a sealing section, and the activation portion forms a bite engagement section that extends longitudinally from the sealing section.

4. The bite valve according to claim 3, wherein the sheath has a distal open end situated near the outlet so that deforming the bite engagement section moves the outlet away from the sheath for passage of fluid through the outlet and through the distal open end of the sheath.

5. The bite valve according to claim 1, wherein one of the sleeve and the sheath is configured to connect to a fluid supply conduit.

6. The bite valve according to claim 5, wherein the inlet of the sleeve is figured to connect to the fluid supply conduit.

7. A bite valve as claimed in claim 1, wherein the sleeve has four outlets for passage of fluid.

8. The bite valve according to claim 4, wherein the bite engagement section extends outwardly from the distal open end of the sheath.

9. The bite valve according to claim 1, wherein the sheath is substantially rigid and the sleeve is elastic.

10. The bite valve according to claim 4, wherein the sheath has an outer dimension that is slightly larger than an inner dimension of the sleeve so that an outer periphery of the sleeve expands and seals against an inner surface of the sheath.

11. The bite valve according to claim 1, wherein the sheath has a distal open end and the outlet is in close proximity to the distal open end.

12. A bite valve comprising:

a sleeve having an inlet and at least one outlet for passage of fluid;

a sheath covering and sealing at least the outlet; and a pair of biting platforms positioned diametrically opposite to each other on the bite engagement section;

wherein the sleeve has an activation portion for moving the outlet away from the sheath to permit passage of fluid through the outlet; and wherein the sleeve is deformable and has an open end that defines the inlet, and has a closed end, the outlet being positioned between the inlet and the closed end and in fluid communication with the inlet;

wherein the sleeve has a sealing section, and the activation portion forms a bite engagement section that extends longitudinally from the sealing section; and wherein the sheath has a distal open end situated near the outlet so that deforming the bite engagement section moves the outlet away from the sheath for passage of fluid through the outlet and through the distal open end of the sheath.

13. A hydration pack comprising:

a reservoir for holding fluid;

a fluid conduit extending from the reservoir for passage of the fluid from the reservoir; and a bite valve connected to a distal end of the fluid conduit, the bite valve comprising:

a sleeve having an inlet and at least one outlet for passage of fluid; and a sheath covering and sealing at least the outlet, wherein the sleeve has an activation portion for moving the outlet away from the sheath to permit passage of fluid through the outlet, wherein the sleeve is deformable and has an open end that defines the inlet, and has a closed end, the outlet being positioned between the inlet and the closed end and in fluid communication with the inlet; and wherein the sheath remains fixed in a longitudinal direction while continuously covering the sleeve before, during, and after activation of the sleeve.

14. The hydration pack according to claim 13, wherein the sleeve has a sealing section, and the activation portion forms a bite engagement section that extends longitudinally from the sealing section.

15. The hydration pack according to claim 14, wherein the sheath has a distal open end situated near the outlet so that deforming the bite engagement section moves the outlet away from the sheath for passage of fluid through the outlet and through the distal open end of the sheath.

16. The hydration pack according to claim 13, wherein one of the sleeve and the sheath is connected to the fluid conduit.

17. The hydration pack according to claim 16, wherein the inlet of the sleeve is connected to the fluid conduit.

18. A hydration pack as claimed in claim 13, wherein the sleeve has four outlets for passage of fluid.

19. A hydration pack comprising:

a reservoir for holding fluid;

a fluid conduit extending from the reservoir for passage of the fluid from the reservoir; and a bite valve connected to a distal end of the fluid conduit, the bite valve including a sleeve having an inlet and at least one outlet for passage of fluid, a sheath covering and sealing at least the outlet, and a pair of biting platforms positioned diametrically opposite to each other on the bite engagement sections;

wherein the sleeve has an activation portion for moving the outlet away from the sheath to permit passage of fluid through the outlet;

wherein the sleeve is deformable and has an open end that defines the inlet, and has a closed end, the outlet being positioned between the inlet and the closed end and in fluid communication with the inlet;

wherein the sleeve has a sealing section, and the activation portion forms a bite engagement section that extends longitudinally from the sealing section; and wherein the sheath has a distal open end situated near the outlet so that deforming the bite engagement section moves the outlet away from the sheath for passage of fluid through the outlet and through the distal open end of the sheath.

* * * * *